US012534256B2

(12) United States Patent
Franek

(10) Patent No.: US 12,534,256 B2
(45) Date of Patent: Jan. 27, 2026

(54) METHOD AND DEVICE FOR FLEXIBLE STRAPPING

(71) Applicant: Mosca GmbH, Waldbrunn (DE)

(72) Inventor: Bernd Franek, Limbach (DE)

(73) Assignee: Mosca GmbH, Waldbrunn (DE)

( * ) Notice: Subject to any disclaimer, the term of this patent is extended or adjusted under 35 U.S.C. 154(b) by 103 days.

(21) Appl. No.: 18/555,317

(22) PCT Filed: Apr. 14, 2022

(86) PCT No.: PCT/EP2022/060136
§ 371 (c)(1),
(2) Date: Oct. 13, 2023

(87) PCT Pub. No.: WO2022/223473
PCT Pub. Date: Oct. 27, 2022

(65) Prior Publication Data

US 2024/0190603 A1 Jun. 13, 2024

(30) Foreign Application Priority Data

Apr. 22, 2021 (DE) ..... 102021110366.5

(51) Int. Cl.
*B65B 59/00* (2006.01)
*B65B 13/04* (2006.01)

(52) U.S. Cl.
CPC ..... *B65B 59/001* (2019.05); *B65B 13/04* (2013.01)

(58) Field of Classification Search
CPC ..... B65B 13/04; B65B 13/14; B65B 13/185; B65B 51/10; B65B 59/001
See application file for complete search history.

(56) References Cited

U.S. PATENT DOCUMENTS 3,949,662 A * 4/1976 Woomer ..... B65B 13/06 100/32
5,400,706 A * 3/1995 Tipton ..... B65B 13/06 53/589

(Continued)

FOREIGN PATENT DOCUMENTS

DE 25 07 717 C3 9/1976
DE 43 37 714 C2 5/1995

(Continued)

OTHER PUBLICATIONS

Machine translation of DE-102019118307-A1 (Year: 2020).*

(Continued)

*Primary Examiner* — Himchan Song
(74) *Attorney, Agent, or Firm* — Westborough IP Group, LLC

(57) ABSTRACT

Strapping goods with a strap is provided by using a strap guide frame to which the strap is fed to form a loop around the goods. The strap guide frame has an upper horizontal section which is formed by a horizontally displaceable and height-adjustable lance which can be displaced from a strapping position closing the strap guide frame into an opening position outside the strap guide frame. A strapping device having a strap guide frame operates reliably with an adjustable height of the displaceable upper horizontal portion of the strap guide frame. A first vertical section of the strap guide frame has a plurality of swivel segments arranged one above the other, and in that the lance is coupled to a vertically acting displacement drive configured to align the lance with one of the swivel segments prior to horizontal insertion into the strapping position.

20 Claims, 9 Drawing Sheets

(56) References Cited

U.S. PATENT DOCUMENTS

| | | | | |
|---|---|---|---|---|
| 6,082,254 | A | 7/2000 | Vlaam | |
| 2006/0168917 | A1 | 8/2006 | Ashkenazi | |
| 2018/0050832 | A1* | 2/2018 | Hurme | B65B 57/12 |
| 2018/0237177 | A1* | 8/2018 | Schultz | B65B 13/181 |
| 2019/0322451 | A1* | 10/2019 | Bastian, II | B65G 1/1375 |
| 2023/0143931 | A1* | 5/2023 | Hu | B65B 13/10 53/399 |
| 2023/0373673 | A1* | 11/2023 | Cornett | B65B 13/16 |

FOREIGN PATENT DOCUMENTS

| | | | |
|---|---|---|---|
| DE | 199 12 940 | A1 | 9/2000 |
| DE | 10 2014 103 336 | A1 | 9/2015 |
| DE | 10 2014 213 791 | A1 | 1/2016 |
| DE | 102019118307 | A1 * | 10/2020 |
| EP | 1 702 844 | B1 | 9/2006 |

OTHER PUBLICATIONS

International Search Report and Written Opinion, Dated Sep. 2, 2022.
International Preliminary Report on Patentability dated Nov. 2, 2023.
German Office Action dated Mar. 10, 2022.

* cited by examiner

METHOD AND DEVICE FOR FLEXIBLE STRAPPING

TECHNICAL FIELD

This application relates to a device for strapping goods with a strapping band (strap).

BACKGROUND

A strapping device is described in DE 10 2019 118 307 A1 of the applicant where it is proposed to equip a machine for strapping goods arranged on pallets with two horizontally displaceable lances, which are both provided with their own insertion drive in order to be displaced separately from one another into the strapping position, in which the lances form the respective horizontally extending sections of the strap guide frame, and into the opening position, in which the lances are located outside the strap guide frame. It is also mentioned that each lance may be associated with at least one height adjustment mechanism for adjusting its height. DE 10 2019 118 307 A1 does not contain any further details on the design of the height adjustment mechanism and, in particular, on the combination of a height-adjustable lance with other areas of the strap guide frame.

SUMMARY OF THE INVENTION

It is desirable to provide a strapping device having a strap guide frame which operates reliably with an adjustable height of the displaceable upper horizontal portion of the strap guide frame.

According to the system described herein, a first vertical section of the strap guide frame has a plurality of swivel segments arranged one above the other, and a lance is coupled to a vertically acting displacement drive configured to align the lance with one of the swivel segments prior to horizontal insertion into the strapping position.

In other words, the vertical section of the strap guide frame through which the lance can be inserted at various heights to form the upper horizontal section of the strap guide frame is provided with a plurality of swivel segments. The swivel segments may swivel open upon insertion of the lance to allow the lance to pass therethrough. The swivel segments may be arranged in immediate succession. However, it is also possible to arrange a plurality of, for example, three or four swivel segments at three or four discrete heights of the vertical section of the strap guide frame. In this case, the lance can be moved only to the predetermined three or four higher positions in which the three or four swivel segments are located.

In a practical embodiment, the plurality of swivel segments may be coupled to a lift drive that can vertically displace the swivel segments by at least the amount of a height of the swivel segments. Such a lift drive has the effect of allowing the lance to be moved continuously to any height positions, rather than only to predetermined discrete positions of the swivel segments. In this embodiment, a segment section extending over the desired vertical travel range of the lance and having, for example, six to 10 swivel segments arranged immediately above one another, may form a certain part, in particular the upper part, of the first vertical section of the strap guide frame. The segment section can then be coupled to the lift drive so that the lift drive raises or lowers all the swivel segments jointly. Each swivel segment must have a height at least equal to the height of the displaceable lance. In a practical embodiment, a first corner guide element can be attached to the lance, the first corner guide element forming the upper end of the vertical section of the strap guide frame when the lance is pushed in and the first corner guide element being pushed through the first vertical section of the strap guide frame together with the lance in the area of one of the swivel segments. In this embodiment, the height of each swivel segment must be equal to the total height of the lance and the first corner guide element attached thereto. Each of the swivel segments defines a height position at which the lance can be inserted. The higher positions have a vertical distance to the respective adjacent height position, which corresponds to the height of a swivel segment. Since the position of the segment section with the swivel segments can be moved by the lift drive over a distance corresponding at least to the height of a swivel segment, the lance can be arranged in any height position in the area of the segment section, with the lift drive aligning the nearest swivel segment to the height of the lance.

In practice, the lance may be coupled to an insertion drive that moves the lance horizontally, and the displacement drive for moving the lance vertically is coupled to the insertion drive to move the insertion drive vertically together with the lance.

In practice, each swivel segment can have a guide surface for the strap on the side facing the central region of the strap guide frame, the guide surface being covered by at least one swivel flap. A strap guide frame usually has a strap guide channel in which the strap is guided with little play. Of great importance is the uninterrupted guidance of the strap on the outer contact surface of the strap channel. Particularly in the area of the corner guide element, where the strap changes feed direction, the strap is pressed outward by the mass inertia against the outer surface of the strap guide channel remote from the center of the strap guide frame. However, it is also important that the strap is guided at the inside of the strap guide frame. On the other hand, the strap loop formed in the strap guide frame must be extractable from the strap channel in order to be tensioned around the good to be packed. For this purpose, the strap guide frame has swivel flaps which are swiveled open by the strap when the strap loop is tensioned and thus release the strap. To ensure that the strap is also reliably guided in the area of the swivel segments of the strap guide frame, each swivel segment can have corresponding swivel flaps. It is possible for one swivel flap to be attached to one side of the swivel segment. However, two swivel flaps may also be provided on the two sides of a swivel segment. When the belt loop is pulled tight, the swivel segments swivel open and open the strap channel.

If, on the other hand, the swivel movement of the swivel segment to allow the lance to pass through displaces a strap channel provided in the swivel segment and open on a narrow side to a position in which the strap can exit the strap channel when the loop is pulled together, swivel flaps on the swivel segment can be dispensed with.

In practice, a second vertical section of the strap guide frame may include a second corner guide element having a receiving area for receiving the free end of the lance in the strapping position. As explained above, the corner guide elements serve to redirect the direction of movement of the strap as the strap passes from a vertical section to a horizontal section of the strap guide frame and vice versa. The first corner guide element, which interacts with the first vertical section of the strap guide frame when the lance is pushed in, is attached to the lance. The second corner guide element, which interacts with the free end of the lance, is attached to the second vertical section of the strap guide frame. To allow the second corner guide element to be aligned with the selected height of the lance, a height adjustment drive is coupled to the second corner guide element.

The height adjustment drive and the displacement drive may be coupled in the following manner to align the height of the second corner guide element with the height of the lance. A mechanical coupling may be provided so that when the lance is moved vertically, a mechanical coupling mechanism causes a corresponding vertical height adjustment of the second corner guide element. In the simplest case, the displacement drive can adjust the height of the lance and be coupled to the corner guide element via a flexible drive mechanism, such as a chain or toothed belt. The engagement mechanism then forms the height adjustment drive, which always adjusts the height of the corner guide element synchronously with the height of the lance. An electronic coupling can be provided, whereby the height of the lance is determined by a measuring device and the height adjustment drive is controlled via a control device so that the second corner guide element is moved to the corresponding height. The measuring device can be, for example, an optical measuring device that measures the set height of the lance. Furthermore, increments and photoelectric sensors can be used to measure the height adjustment of the lance. Finally, when using stepper motors, it is also possible to use signals from the motors themselves to determine the height adjustment. Stepper motors can be equipped with a signal generator that produces signals corresponding to the angle of rotation of the motor shaft. The signals can be used to determine relative values for the height adjustment. Such stepper motors can then be connected to limit switches which indicate that the lance has reached an end position. The control electronics for the height adjustment drive then cause the height of the corner guide element to be aligned with the set height of the lance.

In practice, the lower horizontal section of the strap guide frame can be formed either by a second horizontally displaceable lance or by a stationary lower frame section. In other words, the strap guide frame may consist of a rigid U-shaped frame section with a horizontally and vertically displaceable lance in the upper section only. Alternatively or additionally, it is also possible to provide a horizontally displaceable lance in the lower section. This is particularly advantageous if the lower horizontal section of the strap guide frame is to extend through a pallet, as described in DE 10 2019 118 307 A1.

The system described herein further relates to a method for strapping goods with a strap, in which a strap is fed to a strap guide frame to form a loop around the goods, the strap guide frame having an upper horizontal section which is formed by a horizontally displaceable and height-adjustable lance which is displaced from an opening position outside the strap guide frame into a strapping position closing the strap guide frame.

To solve the above problem, it is proposed that a first vertical section of the strap guide frame has a plurality of swivel segments arranged one above the other, and that the lance is aligned with one of the swivel segments using a vertically acting displacement drive prior to horizontal insertion into the strapping position.

As mentioned, the multiple swivel segments may be coupled to a lift drive that vertically shifts the swivel segments to a target position as needed.

The lance may be coupled to an insertion drive that moves the lance horizontally, and the displacement drive may engage the insertion drive to move the insertion drive vertically.

As mentioned above, a first corner guide element may be attached to the lance, which forms the upper end of a vertical section of the strip guide frame when the lance is inserted and is pushed through the first vertical section of the strip guide frame together with the lance in the area of one of the swivel segments.

Further, a second vertical portion of the strap guide frame may include a second corner guide element having a receiving area for receiving the free end of the lance in the strapping position, where a height adjustment drive is coupled to the second corner guide element and aligns the second corner guide element with the height of the lance. The coupling may be mechanical or electronic as described above.

BRIEF DESCRIPTION OF DRAWINGS

Further practical embodiments and advantages of the system described herein are described below in connection with the drawings.

DETAILED DESCRIPTION OF VARIOUS EMBODIMENTS

Figure 1:
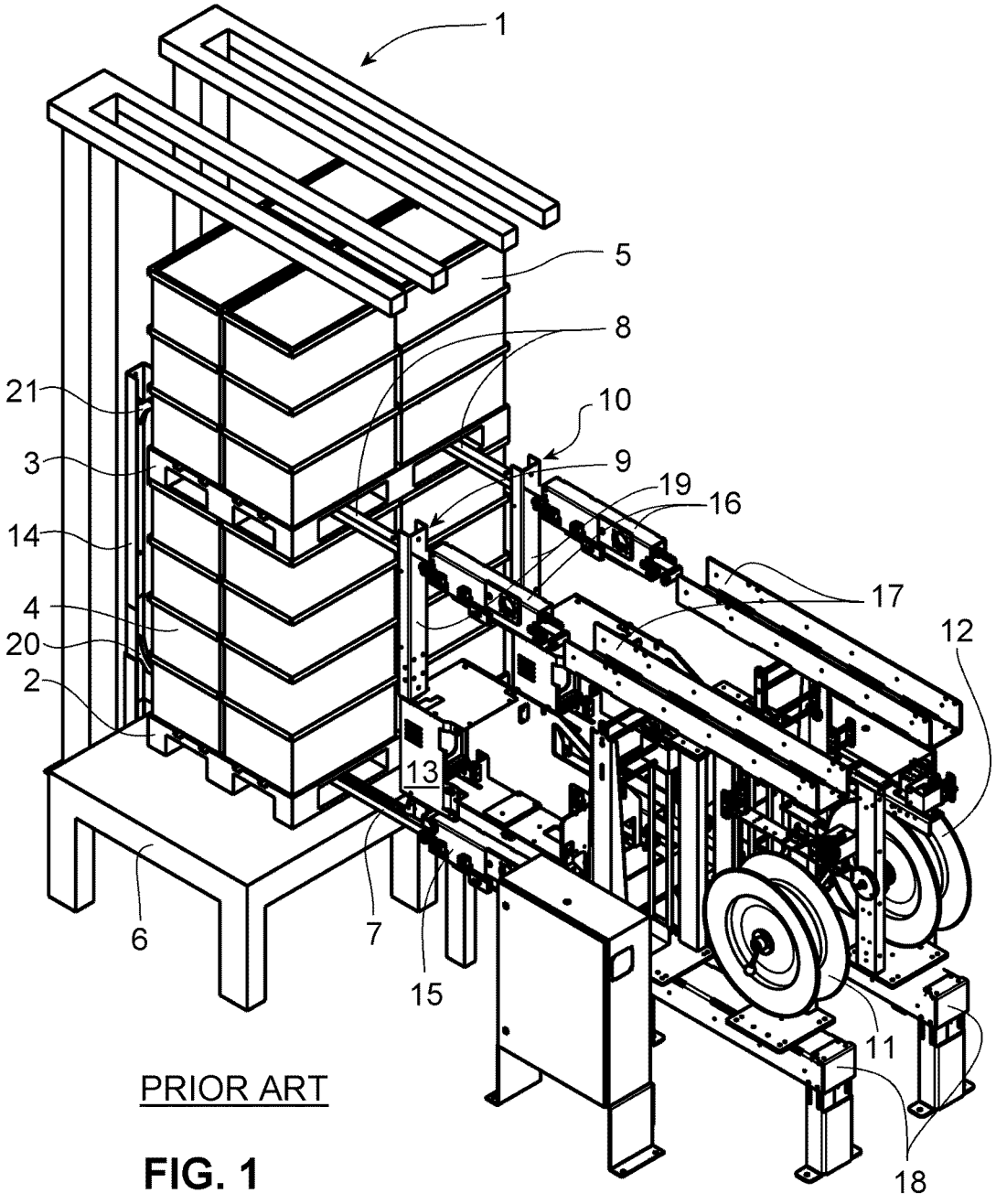
PRIOR ART FIG. 1
FIG. 1 shows a three-dimensional view of a strapping device for pallets with goods according to the state of the art.

FIG. 1 shows the strapping station 1 from the prior art according to DE 10 2019 118 307 A1. In the strapping station 1, there is a bundle consisting of two pallets 2, 3 and goods 4, 5 stacked thereon. A support table 6 is shown schematically, on which the lower pallet 2 is placed, for example, by a fork-lift truck. In practice, a roller conveyor can alternatively be arranged at the height of the support table 6, which automatically conveys the lower pallet 2 into the strapping station 1.

A horizontal lance 7 projects through the lower pallet 2. A further lance 8 projects through the upper pallet 3. The pallets may be so-called EURO pallets or WORLD pallets, which have skid boards on the underside and deck boards on the upper side. The lances 7, 8 protrude through a space between the skid board and the deck board. However, other pallet constructions can also be used. The pallets have a free space through which one of the two lances 7, 8 can be passed. In FIG. 1, it can be seen that two mutually parallel strap guide frames 9, 10 are provided. Both strap guide frames 9, 10 are constructed identically to each other, so that in the following only the strap guide frame 9 lying in front for the viewer is described.

The lower lance 7 forms the lower leg of the strap guide frame. In a known manner, the strap guide frame has a strap channel through which a strap can be guided. The strap is wound on a strap coil 11. It can be seen that a second strap coil 12 is assigned to the second strap guide frame 10.

A drive and tensioning unit 13 pulls the strap from the strap coil 11 and feeds the strap to the strap channel in the lower lance 7. In the closed position of the strap guide frame 9, the lower lance 7 extends to a corner guide element 20 on the rear fixed frame member 14, which forms a vertically extending section of the strap guide frame 9. A horizontal section of a tape channel is arranged in the lance 7. The corner guide element 20 has a concave curved surface which deflects the strap from the horizontal to the vertical direction. In the vertical frame member 14, the strap is guided vertically upward. At the top, the strap exits the vertical section of the strap channel in the vertical frame member 14 and is deflected by an upper corner guide element 21 of the strap guide frame 9 into the horizontal direction to the front end of the upper lance 8. The upper lance 8 also has a horizontal section of strap channel that guides the strap back through the upper pallet 3 to the side of the drive and tensioning unit 13. From the strap channel in the lance 8, the strap enters a vertical section 19 that guides the strap back to the drive and tensioning unit 13. The drive and tensioning unit 13 then pulls the strapping back so that the formed strap loop is pulled together and tensioned around the strapped goods. For this purpose, the inside of the strap guide frame 9, 10 has swivel flaps which open when the strap loop is contracted and allow the strap to exit from the strap guide channel. The tensioned strap loop is then closed. The drive and tensioning unit 13 also houses the connecting device which, after the strap loop has been pulled tight and tensioned, seals the strap loop. For this purpose, two overlapping ends of the strap loop are usually welded together.

It can be seen that by passing two lances 7, 8 through two pallets 2, 3, a secure and firm connection of the pallets 2, 3 can be created, especially because tape loops are created by two strap guide frames 9, 10 in two parallel and spaced vertical planes.

The upper pallet 3 can be strapped in the same manner before the upper pallet 3 is placed on the lower pallet 2. In this way, the entire pack is completely secured.

Figure 2:
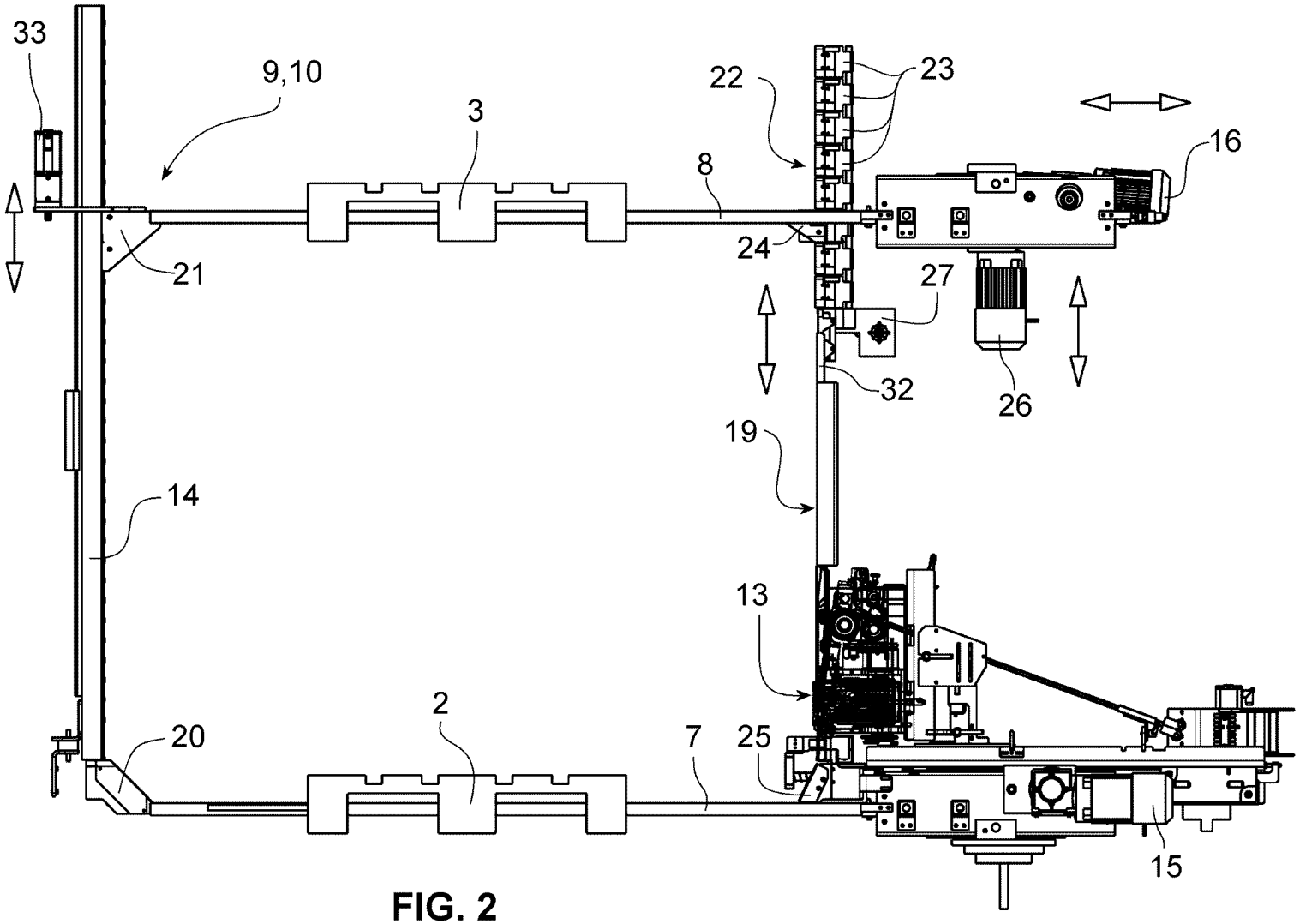
FIG. 2 shows a side view of a strap guide frame according to the system described herein.
Figure 3:
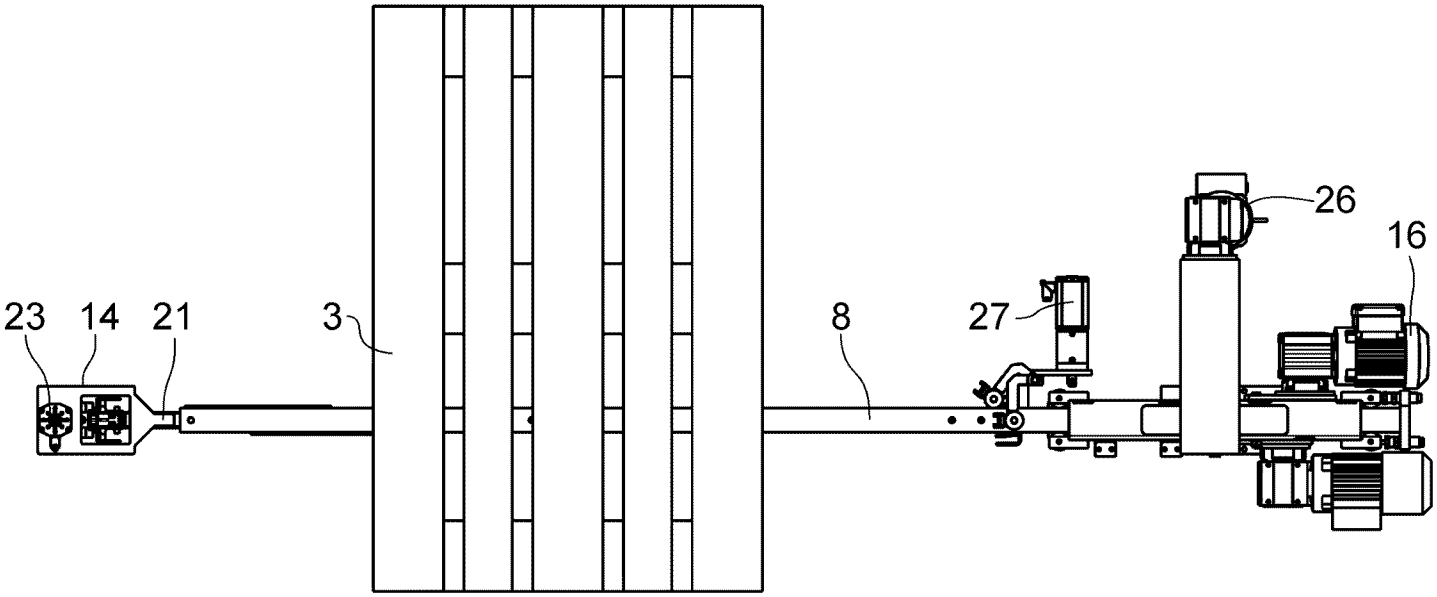
FIG. 3 shows a top view of the strap guide frame from FIG. 2.

It should be noted that FIG. 1 does not fully show the support structures for all components of the strapping device. For example, no support structure for the insertion drives 15, 16 for the two lances 7, 8 is shown in FIGS. 1 and 2. Behind the insertion drives 15, 16 for the two lances 7, 8, support profiles 17, 18 are shown, the attachment of which is also not shown in FIG. 1. The support profiles 17, 18 are fastened to a usual supporting frame. The components which enable the height adjustment of the upper lance 8 are also missing in FIG. 1 and are shown in FIGS. 2 to 9, as explained below.

FIG. 2 shows a side view of a strap guide frame with height adjustment of the upper lance 8. The strap guide frame can form both the front strap guide frame 9 and the rear strap guide frame 10 in the device of FIG. 1. For reasons of clarity, the goods are not shown in FIGS. 2-4. The positions of the pallets 2, 3 are drawn for orientation.

Figure 4:
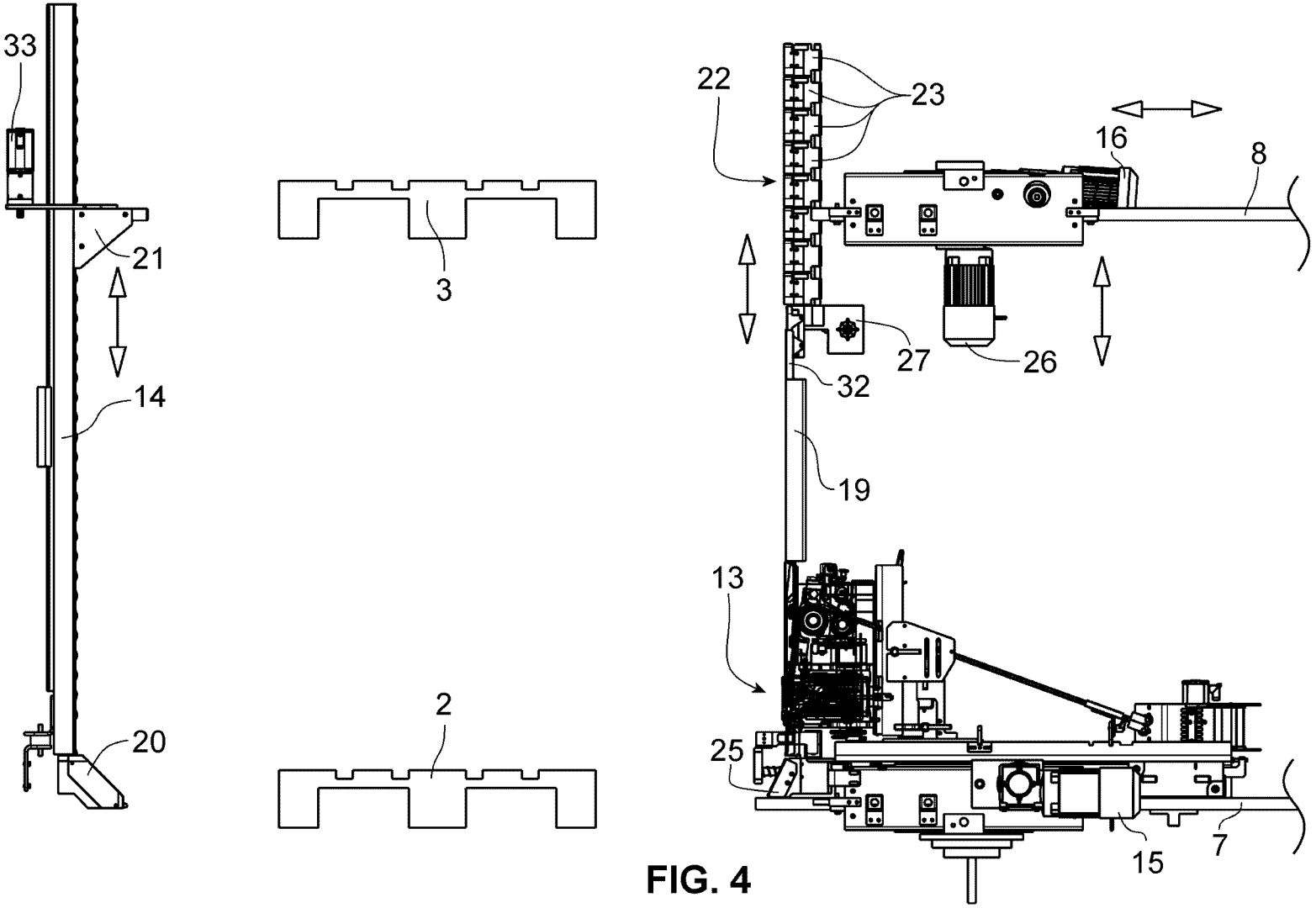
FIG. 4 shows a side view of the strap guide frame from FIG. 2 in the open position.
Figure 5:
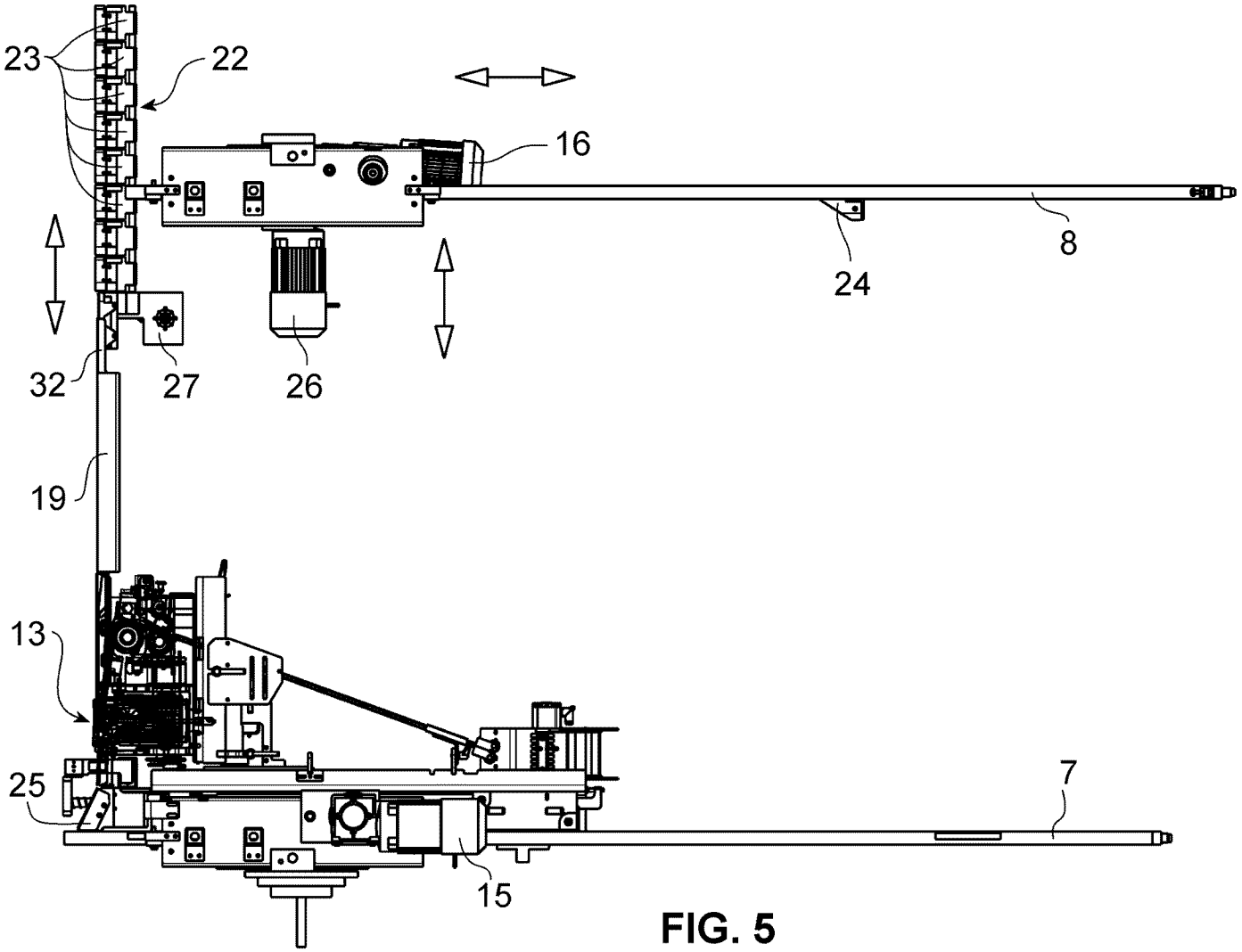
FIG. 5 shows a complete side view of the lances of the strap guide frame from FIG. 4.

In particular, it can be seen in FIGS. 2 and 4 that the upper section of the vertical section 19 of the strap guide frame located on the right side is formed by a segment section 22, which has eight successive swivel segments 23 vertically one above the other. The swivel segments 23 allow the upper lance 8 to be inserted through the vertical section 19 into the interior of the strap guide frame 9, 10.

Corner guide elements 24, 25 are also arranged on the vertical section 19 of the strap guide frame 9, 10, which guide the strap. The lower corner guide element 25 is permanently installed. The upper corner guide element 24 is attached to the upper lance 8. This can be seen in FIG. 5. When the upper lance 8 is pushed into the strap guide frame 9, 10, the corner guide element 24 attached to the upper lance 8 is pushed with the upper lance 8 through the swivel segment 23. Consequently, the height of a swivel segment 23 corresponds to the total height of the upper lance 8 and the corner guide element 24 attached thereto. The height of a swivel segment 23 is therefore several centimeters. The height displacement of the upper lance 8 relative to the segment section 22 is thus only possible in steps corresponding to the height of a swivel segment 23.

In order to achieve a stepless height adjustment of the upper lance 8, a height displacement of the segment section 22 can also be provided. The segment section 22 can be vertically displaced in a range which corresponds at least to the height of a swivel segment 23.

Figure 6:
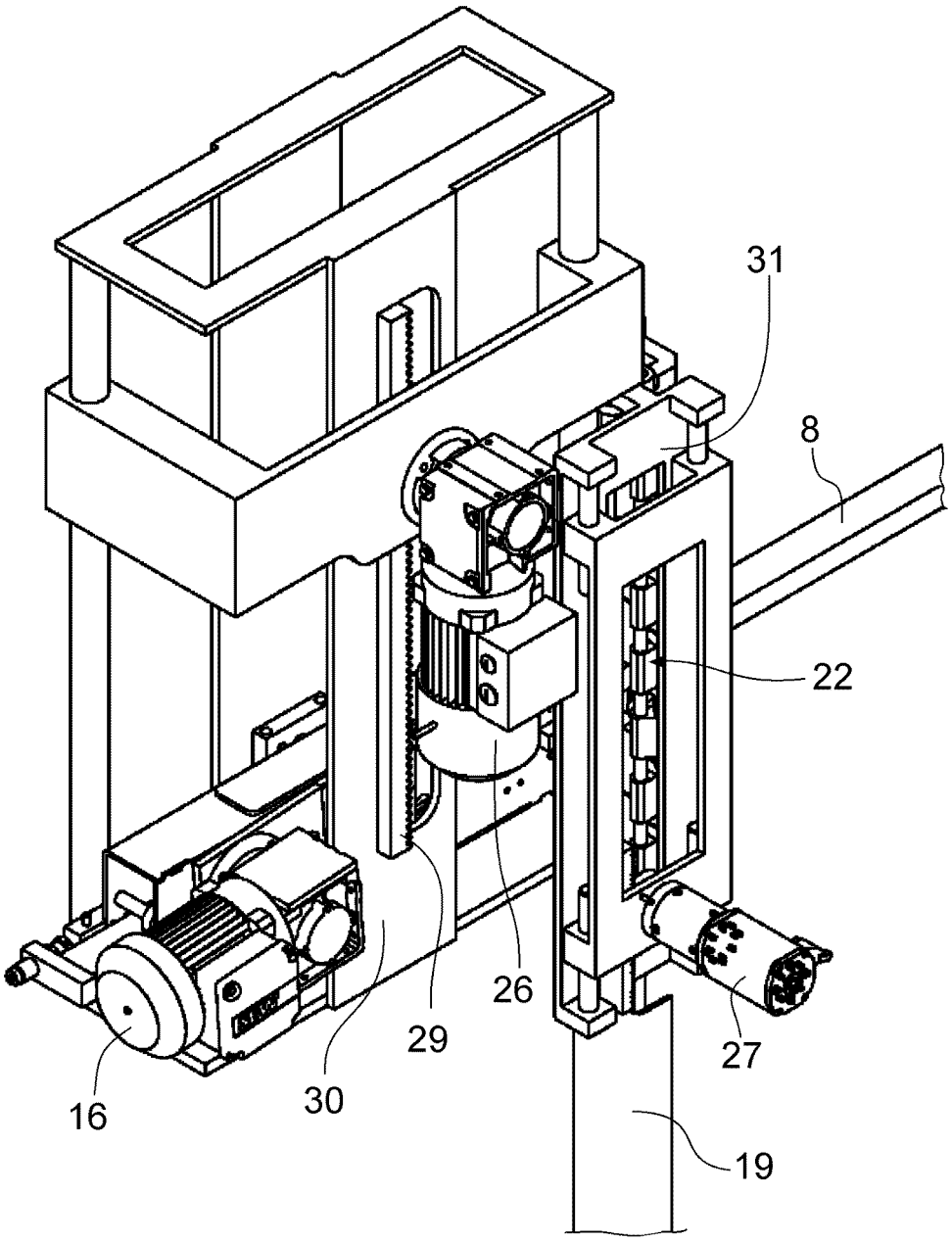
FIG. 6 shows a first three-dimensional side view of the displacement drive for the upper lance from FIG. 5.
Figure 7:
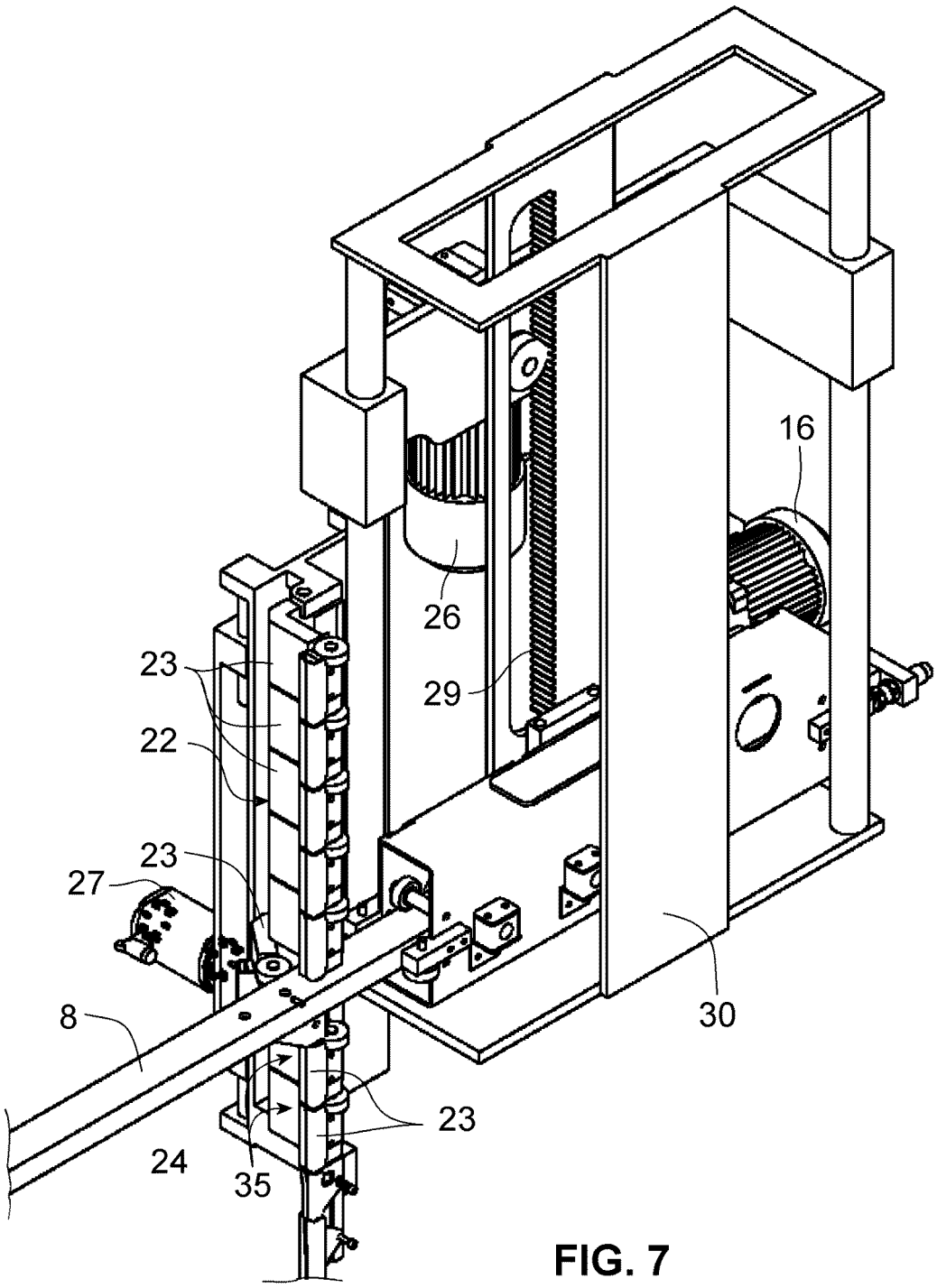
FIG. 7 shows a second three-dimensional side view of the displacement drive for the upper lance from FIG. 5.

FIGS. 6 and 7 show the parts of an exemplary embodiment of the displacement drive 26 for the upper lance 8 and the lift drive 27 for the segment section 22. The coupling of the displacement drive 26 and the lift drive 27 with the lance 8 and the segment section 22 is not shown in the preceding FIGS. 2-5 for reasons of clarity. The displacement drive 26 is an electric motor that acts via a gear wheel 28 on a toothed rack 29 that is attached to a support member 30. The support member 30 supports the insertion drive 16 of the upper lance 8. The displacement drive 26 can be supported by a suitable support frame, which is not shown in the figures. The displacement drive 26 can be used to align the insertion drive 16 with the upper lance 8 coupled thereto to the height of one of the swivel segments 23. This can be seen, for example, in FIG. 7, in which the upper lance 8 is aligned with the third swivel segment 23 from below and the swivel segment 23 is pivoted open, the upper lance 8 projecting through the vertical plane of the vertical section 19 of the strap guide frame 9, 10 in the height region of the pivoted-open swivel segment 23.

The lift drive 27 in turn effects a height adjustment of the segment section 22 of the vertical section 19 of the strap guide frame 9, 10. The lift drive 27 acts on a support frame 31 to which the segment section 22 is attached. The lower end 32 of the segment section 22 is telescopically displaceable relative to the vertical section 19 of the strap guide frame 9, 10 (see FIGS. 2, 4, 5).

In FIG. 7, the sides of the swivel segments 23 facing the center of the strap guide frame 9, 10 can be seen. The swivel segments 23 have a swivel flap 35 which swings open when the strap is pulled out of the section of the strap guide channel formed by the respective swivel segment 23. The swivel flap 35 may be elastically deformable or rigid and designed to swivel about an axis. Examples of elastically deformable swivel flaps are disclosed in DE 10 2014 213 791 A1. Rigid swivel flaps are known, for example, from DE 25 07 717 C3. Magnetic swivel flaps 35 are also known, for example from EP 1 702 844 B1.

Figure 8:
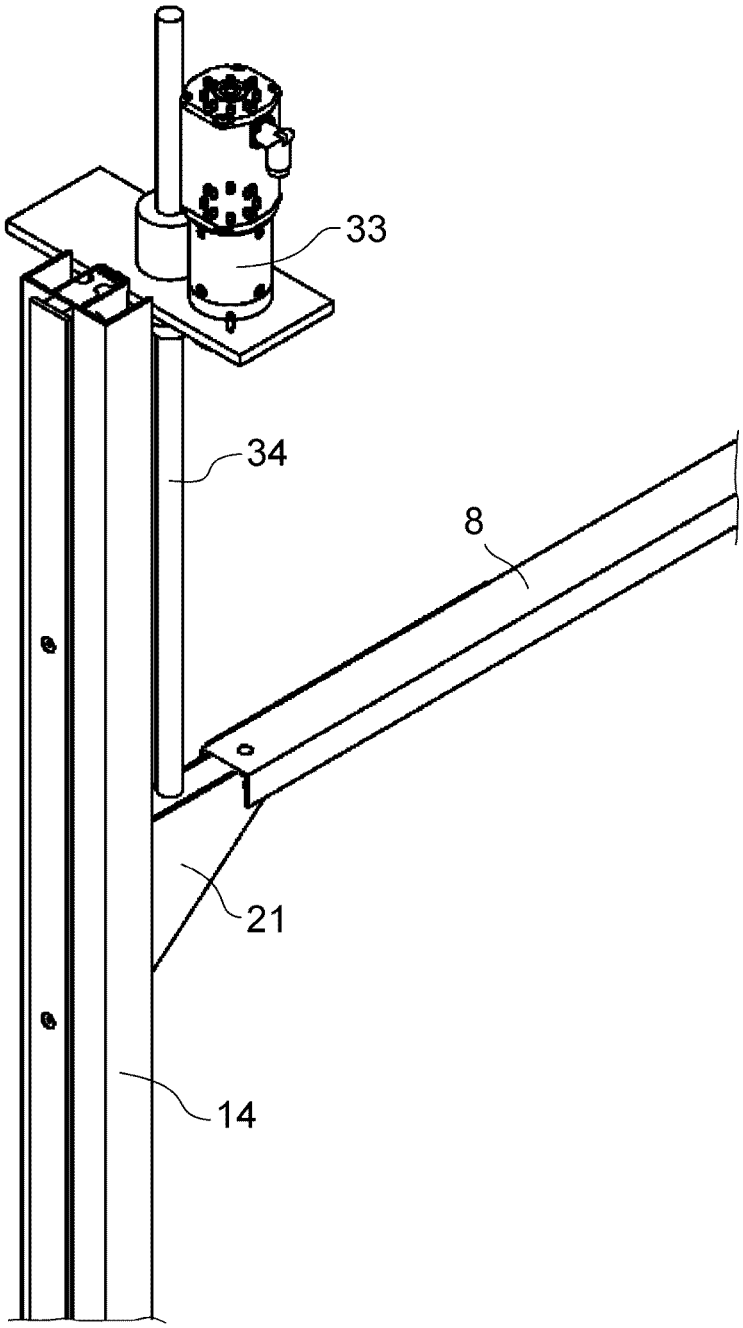
FIG. 8 shows a first three-dimensional view of the height adjustment drive for a corner guide element of the strap guide frame.
Figure 9:
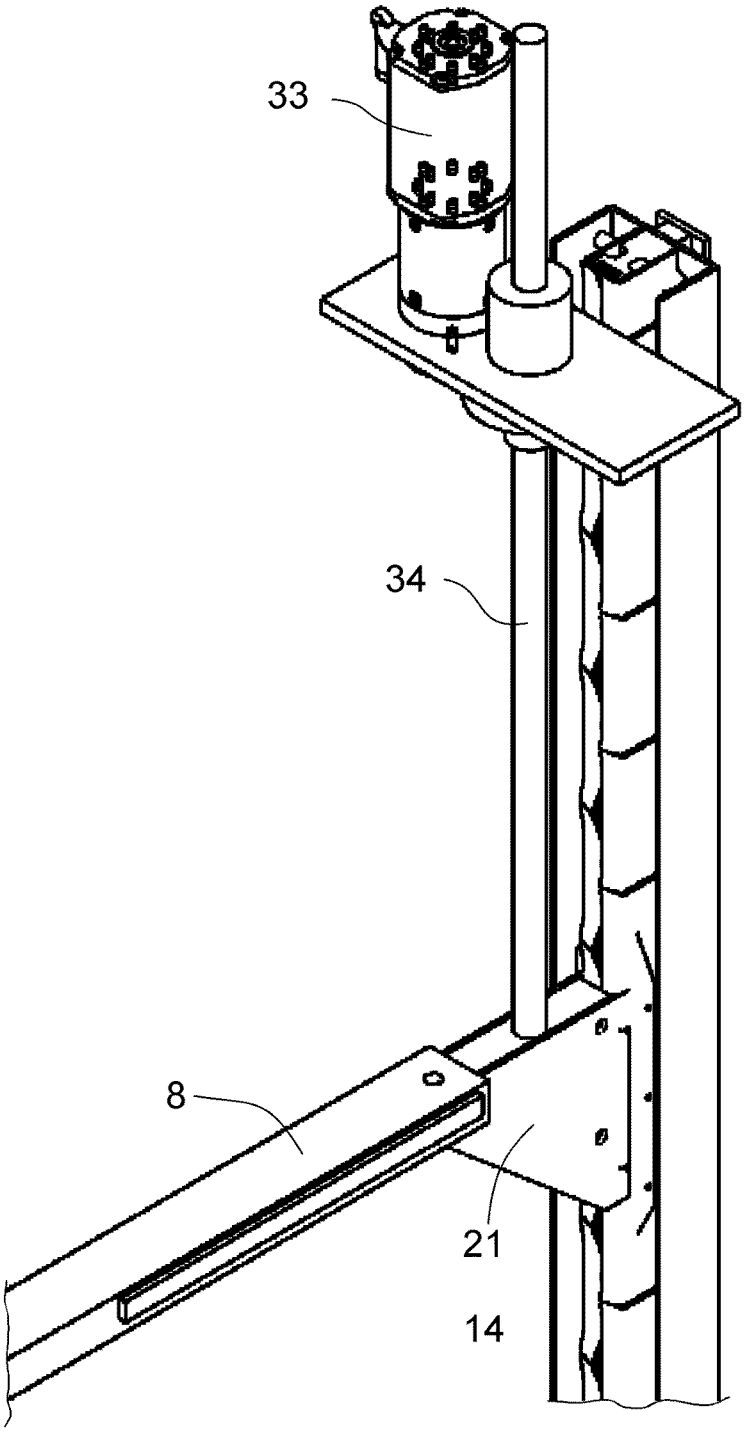
FIG. 9 shows a second three-dimensional view of the height adjustment drive for a corner guide element of the strap guide frame.

FIGS. 8 and 9 show the height adjustment drive 33 for the upper corner guide element 21 of the strap guide frame 9, 10. In the embodiment shown, the height adjustment drive 33 is again an electric motor that acts on a threaded rod 34 via a gear train. The threaded rod 34 causes a vertical displacement of the corner guide element 21. The height of the upper lance 8 can be measured by a suitable sensor, and a control device adjusts the corresponding height of the corner guide element 21 via the height adjustment drive 33. As an alternative to such an electronic coupling of the height of the lance 8 and the corner guide element 21, a mechanical coupling can of course also take place, in which, for example, a chain or an inextensible drive belt indirectly transmits the movement of the lance 8 to the corner guide element 21.

It should be noted that the drive mechanism for the height adjustment are only presented as examples. Instead of the electric motors shown, linear drives can also be used for the height adjustment. The motion coupling between the drives and the previously adjusting elements (lance 8 and corner guide element 21 as well as segment section 22) also does not have to be effected via gear wheels but can be effected by any other known coupling elements. Finally, it is also possible to make the lower lance 7 height-adjustable by an analog drive mechanism if this is required for a particular application.

The features of the invention disclosed in the present description, in the drawings as well as in the claims may be essential, both individually and in any combination, for the realization of the invention in its various embodiments. The invention is not limited to the embodiments described. It may be varied within the scope of the claims and with due regard to the knowledge of the person skilled in the art.

The invention claimed is:

1. A device for strapping goods with a strap, comprising:

a strap guide frame to which the strap is fed to form a loop around the goods;

a horizontally displaceable and height-adjustable lance provided in an upper horizontal section of the strap guide frame and which can be displaced from a strapping position closing the strap guide frame into an opening position outside the strap guide frame; and a plurality of swivel segments arranged in a first vertical section of the strap guide frame one above the other, wherein the lance is coupled to a vertically acting displacement drive configured to align the lance with one of the swivel segments before horizontal insertion of the lance into the strapping position.

2. The device according to claim 1, wherein the plurality of swivel segments are coupled to a lift drive which is configured to displace the swivel segments vertically at least by a height of the swivel segments.

3. The device according to claim 1, wherein the lance is coupled to an insertion drive which displaces the lance horizontally, and wherein the displacement drive is configured to move the insertion drive vertically.

4. The device according to claim 1, wherein each of the plurality of swivel segments has a guide surface for the strap on a side facing a central region of the strap guide frame, wherein the guide surface is covered by at least one swivel flap.

5. The device according to claim 1, wherein a first corner guide element is fastened to the lance and forms an upper end of the first vertical section of the strap guide frame when the lance is inserted and wherein the first corner guide element can be pushed with the lance through the first vertical section of the strap guide frame in the region of one of the swivel segments.

6. The device according to any claim 5, wherein a second vertical portion of the strap guide frame includes a second corner guide element having a receiving area for receiving a free end of the lance in the strapping position, and wherein a height adjustment drive is coupled to the second corner guide element and is configured to align the second corner guide element with a height of the lance.

7. The device according to claim 6, wherein the displacement drive and the height adjustment drive are coupled to each other for aligning a height of the second corner guide element with the height of the lance using either a mechanical coupling mechanism which, when the lance is moved vertically, causes a corresponding vertical height adjustment of the second corner guide element or using an electronic coupling mechanism, wherein a measuring device determines the height of the lance and a control device controls the height of the adjustment drive in order to move the second corner guide element to a corresponding height.

8. The device according to any claim 1, wherein the lower horizontal portion of the strap guide frame is formed by either a second horizontally displaceable lance or a stationary lower frame section.

9. A method for strapping goods with a strap, comprising:

feeding a strap to a strap guide frame to form a loop around the goods, the strap guide frame having an upper horizontal section which is formed by a horizontally displaceable and height-adjustable lance which is displaceable from an open position outside the strap guide frame into a strapping position which closes the strap guide frame, wherein a first vertical section of the strap guide frame has a plurality of swivel segments arranged one above the other; and aligning the lance with one of the swivel segments using a vertically acting displacement drive before the lance is pushed horizontally into the strapping position.

10. The method of claim 9, wherein the plurality of swivel segments are coupled to a lift drive that vertically displaces the swivel segments to a desired position when needed.

11. The method according to claim 9, wherein the lance is coupled to an insertion drive which displaces the lance horizontally, and wherein the displacement drive moves the insertion drive vertically.

12. The method according to claim 9, wherein a first corner guide element is fastened to the lance and forms an upper end of the first vertical section of the strap guide frame when the lance is inserted, the first corner guide element being pushed together with the lance through the first vertical section of the strap guide frame in a region of one of the swivel segments.

13. The method according to claim 12, wherein a second vertical section of the strap guide frame includes a second corner guide element having a receiving area for receiving a free end of the lance in the strapping position, wherein a height adjustment drive is coupled to the second corner guide element and aligns the second corner guide element to a height of the lance.

14. The method according to claim 13, wherein the displacement drive and the height adjustment drive are coupled together for aligning the height of the second corner guide element with the height of the lance using either a mechanical coupling mechanism which, when the lance is moved vertically, causes a corresponding vertical height adjustment of the second corner guide element or using an electronic coupling mechanism, wherein a measuring device determines the height of the lance and a control device controls the height of the adjustment drive in order to move the second corner guide element to a corresponding height.

15. The device according to claim 3, wherein a first corner guide element is fastened to the lance and forms an upper end of the first vertical section of the strap guide frame when the lance is inserted and wherein the first corner guide can be pushed with the lance through the first vertical section of the strap guide frame in the region of one of the swivel segments.

16. The device according to any claim 15, wherein a second vertical portion of the strap guide frame includes a second corner guide element having a receiving area for receiving a free end of the lance in the strapping position, and wherein a height adjustment drive is coupled to the second corner guide element and is configured to align the second corner guide element with a height of the lance.

17. The device according to claim 16, wherein the displacement drive and the height adjustment drive are coupled to each other for aligning a height of the second corner guide element with the height of the lance using either a mechanical coupling mechanism which, when the lance is moved vertically, causes a corresponding vertical height adjustment of the second corner guide element or using an electronic coupling mechanism, wherein a measuring device determines the height of the lance and a control device controls the height of the adjustment drive in order to move the second corner guide element to a corresponding height.

18. The method according to claim 11, wherein a first corner guide element is fastened to the lance and forms an upper end of the first vertical section of the strap guide frame when the lance is inserted, the first corner guide element being pushed together with the lance through the first vertical section of the strap guide frame in a region of one of the swivel segments.

19. The method according to claim 18, wherein a second vertical section of the strap guide frame includes a second corner guide element having a receiving area for receiving a free end of the lance in the strapping position, wherein a height adjustment drive is coupled to the second corner guide element and aligns the second corner guide element to a height of the lance.

20. The method according to claim 19, wherein the displacement drive and the height adjustment drive are coupled together for aligning the height of the second corner guide element with the height of the lance using either a mechanical coupling mechanism which, when the lance is moved vertically, causes a corresponding vertical height adjustment of the second corner guide element or using an electronic coupling mechanism, wherein a measuring device determines the height of the lance and a control device controls the height of the adjustment drive in order to move the second corner guide element to a corresponding height.

* * * * *